US005094366A

United States Patent [19]

Lin

[11] Patent Number: 5,094,366

[45] Date of Patent: Mar. 10, 1992

[54] DISPENSING MEANS FOR CHEMICAL SOLUTION

[76] Inventor: Li-Hua Lin, No. 79, Sec. 2, Yung-Fu Rd., Tainan City, Taiwan

[21] Appl. No.: 600,400

[22] Filed: Oct. 19, 1990

[30] Foreign Application Priority Data

Aug. 29, 1990 [TW] Taiwan ..... 79209630

[51] Int. Cl.[5] ..... F04F 10/00

[52] U.S. Cl. ..... 222/416

[58] Field of Search ..... 222/204, 416; 137/142, 137/145, 151

[56] References Cited

U.S. PATENT DOCUMENTS

| | | | |
|---|---|---|---|
| 359,502 | 3/1887 | Denison | 137/145 |
| 453,519 | 6/1891 | Stifel | 222/204 |
| 466,336 | 1/1892 | Franklin | 222/204 |
| 503,232 | 8/1893 | Franklin | 222/204 |
| 636,537 | 11/1899 | Lippincott et al. | 137/145 |
| 1,030,378 | 6/1912 | Beckwith | 222/416 |
| 1,293,017 | 2/1919 | Broche | 222/416 |
| 2,606,690 | 8/1952 | Hansen | 222/204 |
| 2,779,349 | 1/1957 | Eyck | 137/145 |
| 3,407,973 | 10/1968 | Scott | 222/204 |
| 3,783,888 | 11/1974 | Johnson | 137/145 |

FOREIGN PATENT DOCUMENTS

| | | | |
|---|---|---|---|
| 498352 | 1/1920 | France | 222/416 |
| 811133 | 4/1937 | France | 222/416 |
| 1009175 | 11/1965 | United Kingdom | 222/416 |
| 1134483 | 11/1968 | United Kingdom | 222/204 |

*Primary Examiner*—Michael S. Huppert
*Assistant Examiner*—Kenneth Bomberg
*Attorney, Agent, or Firm*—Nixon & Vanderhye

[57] ABSTRACT

A container has a bottom closed end, a top closed end and a chamber defined by them. A tubular member has an opening at its top which is detachably sealed. The tubular member is in communication with the chamber. A first and a second auxiliary tubes are in communication with the chamber and they are disposed on the top closed end of the chamber. The first auxiliary tube has a predetermined height, and the second auxiliary tube has a lesser height than the first. One end of a siphon tube passes through the seal of the second tube and is disposed adjacent to the bottom of the chamber. The other end of the siphon tube extends out of the second auxiliary tube and leads downward from the same.

3 Claims, 5 Drawing Sheets

DISPENSING MEANS FOR CHEMICAL SOLUTION

BACKGROUND OF THE INVENTION

The invention relates to a container, more particularly, to a container for receiving chemical liquid and siphoning out a controlled amount of the same.

FIG. 1 shows a conventional chemical container (A). Accordingly, the container (A) has an opening (A1) at its base, which opening is blocked by a rubber stopper (A2). One end of a tube (A31) leads from the inside of the container (A) to the exterior of the same, through the rubber stopper (A2). A pipe (A3) with a means (A4) for closing and opening the same is connected to the outer end of the tube (A31). The chemical liquid inside the container (A) is tapped just by opening and/or closing the pipe (A3).

Such a container has a number of drawbacks; (a) the rubber member (A2), in the long run, may react with the chemical liquid and may sustain chemical changes, which could allow the chemical liquid solution to flow out of the container; (b) if the chemical liquid is a suspension, such as a lime solution, which will eventually settle, the outlet tube (A31) could be blocked or clogged; (c) if the pipe (A3) is accidentally ruptured, the container must first be leaned on its side to stop the flow of the chemical liquid, then emptied into an intact container.

FIG. 2 shows a prior art improved container which is widely used in school laboratories. Accordingly, the container includes a lower portion and an upper portion. One end of a siphon tube passes through the seal of the lower portion, and the other end of the siphon tube, is disposed adjacent to the bottom of the container. There must be a considerable amount of chemical solution in the container in order to get the siphon to work, and by the same token, it is not possible to siphon a controlled amount of solution therefrom when there is only a small amount of solution in the container.

SUMMARY OF THE INVENTION

Therefore, the main object of the present invention is to provide a chemical container which is free from the above drawbacks.

Another object of the present invention is to provide a chemical liquid container from which the liquid can be safely siphoned out even though the container has a small amount of liquid without applying a suction force from the exterior thereof.

According to the present invention, the container includes two closed ends defining a chamber. A tubular member has a volume preferably larger than the chamber, and is in communication with the same. The opening of the tubular member is detachably sealed. A first auxiliary tube with a predetermined height is in communication with the chamber. A second auxiliary tube is shorter than the first auxiliary tube, and is in communication with the chamber. The openings of the first and second auxiliary tubes are detachably sealed. One end of a siphon tube passes through the seal of the second auxiliary tube and is disposed adjacent to the bottom of the chamber, the other end extends out of the second auxiliary tube, and is disposed at a position lower than the bottom closed end. The tube has a means for closing and opening the same.

The container as described can provide a siphon phenomenon even if there is a limited amount of chemical solution in the container. The limited amounted of chemical solution is poured through the first auxiliary tube, while the outer end of the siphon tube is opened. At this time, the openings of the tubular member of the container and the second auxiliary tube must be sealed. In addition, the opening of the first auxiliary tube must also be closed. A siphon phenomenon occurs in the container when the outer end of the siphon tube is opened, so that a limited amount of chemical liquid can be safely tapped at any time.

BRIEF DESCRIPTION OF THE DRAWING

Other features and advantages of the present invention will become apparent in the following detailed description including drawings, all of which show a non-limiting form of the invention, and of which.

DETAILED DESCRIPTION OF THE PREFERRED EMBODIMENT

Figure 2:
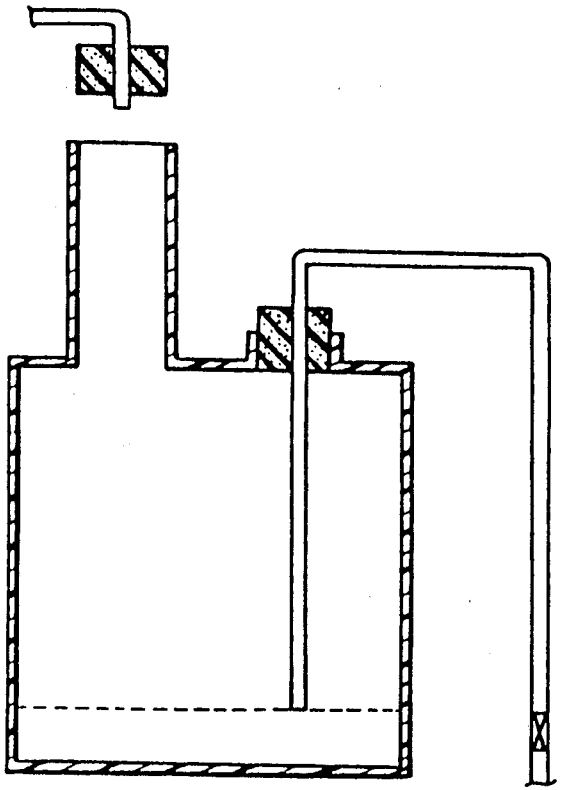
Fig. 2 PRIOR ART
FIG. 2 shows another prior art container for chemical liquid.
Figure 1:
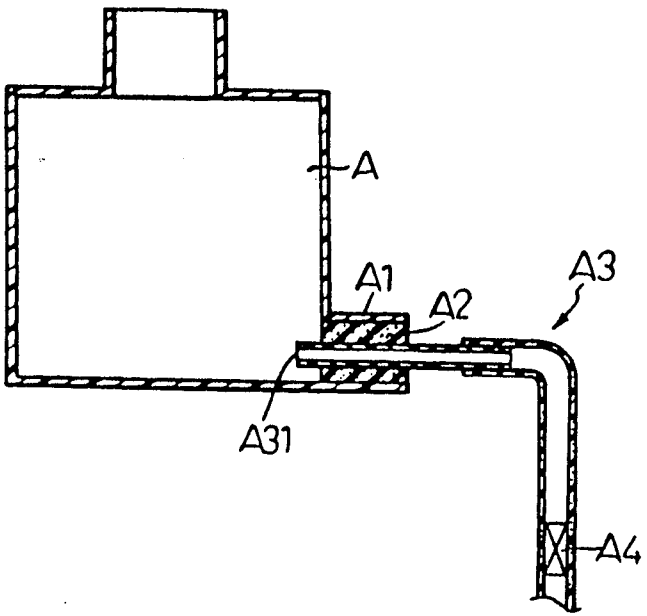
Fig. 1 PRIOR ART
FIG. 1 shows a prior art container for chemical liquid.
Figure 4:
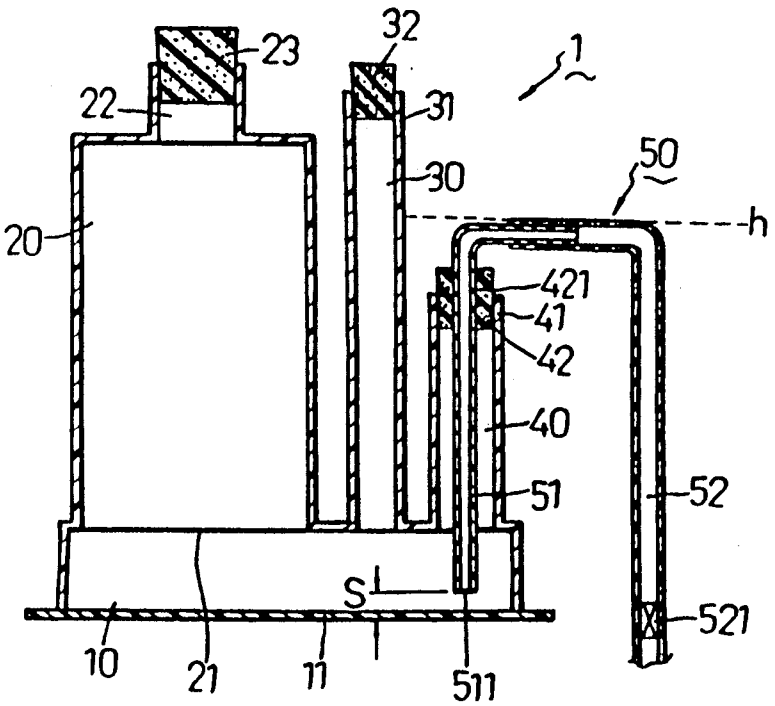
FIG. 4 shows a cross sectional view of the container of FIG. 3.
Figure 3:
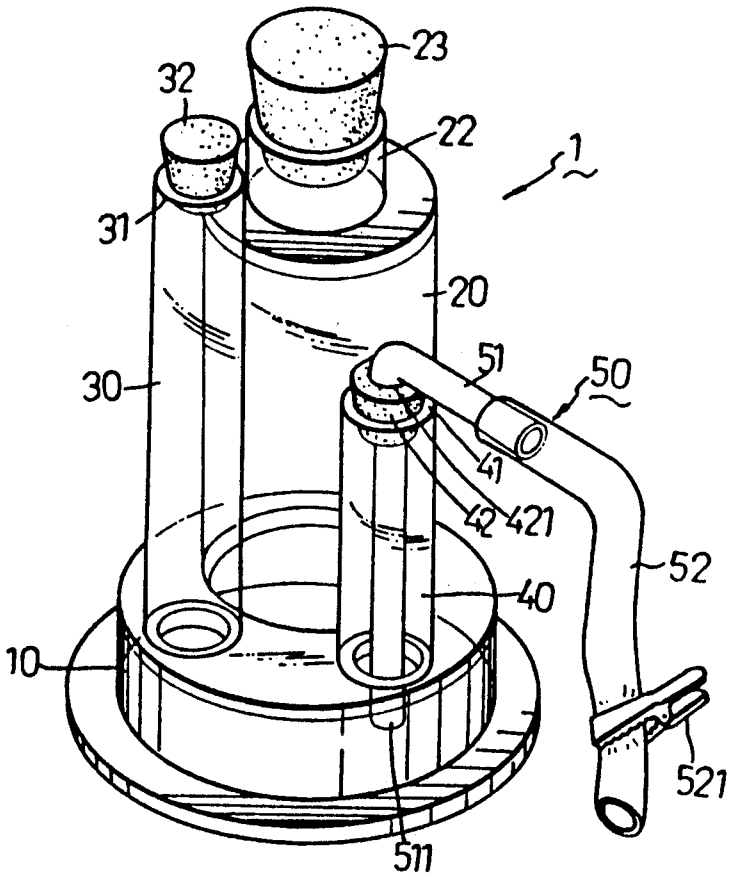
FIG. 3 shows a perspective view of a chemical liquid container produced according to the present invention.

Referring to FIGS. 3 and 4, a chemical liquid container (1) produced according to the present invention, includes a lower portion (10) and an upper portion (20) separated by a plate (21). From the depiction, it is readily understandable that the upper portion (20) has a volume far greater than that the lower portion (10), and it is disposed over the lower portion (10). The upper portion (20) has an opening (22) which is detachably sealed by a cork (23).

A first auxiliary tube (30) with a predetermined height is formed over and communicated with the lower portion (10). It has an opening (31) at the top which is detachably sealed by a cork(32). A second auxiliary tube (40), which has a lesser height but which may have a greater diameter than the first auxiliary tube (30), is also disposed over and communicated with the lower portion (10). The second auxiliary tube (40) also has an opening (421) at the top and which is detachably sealed by a cork (42).

Figure 7:
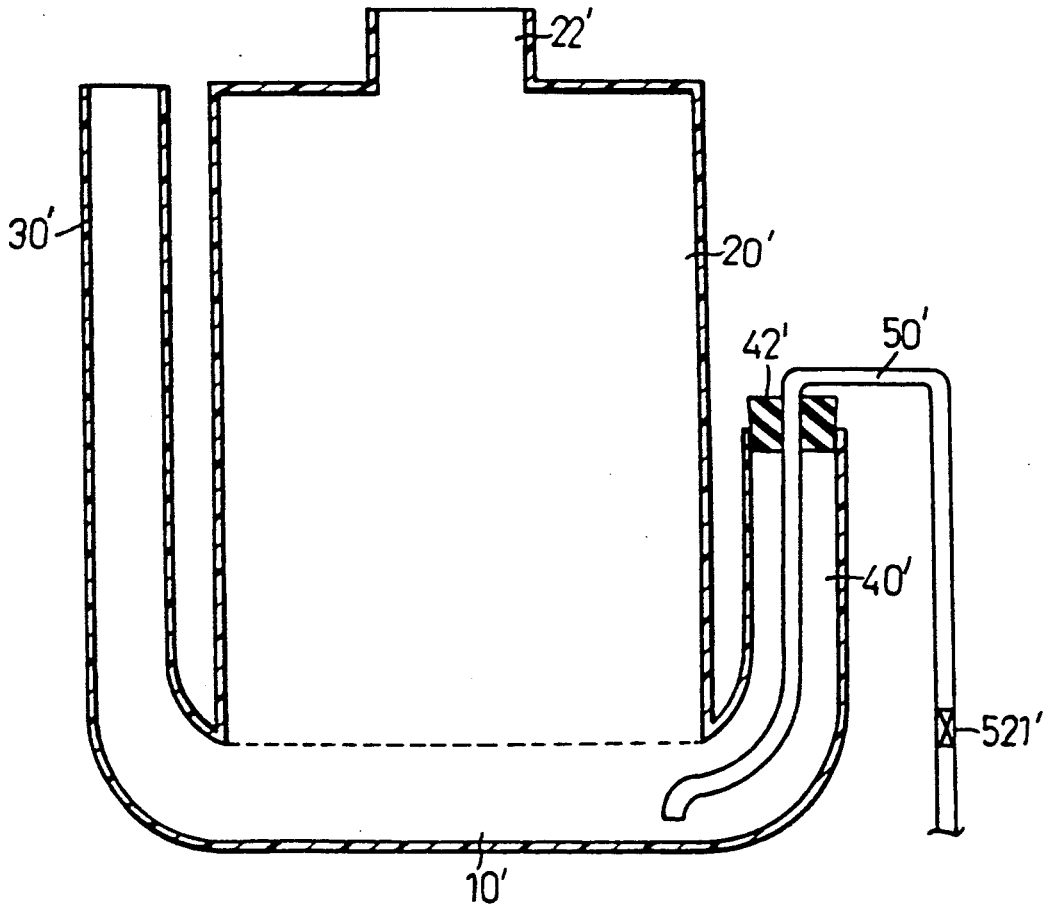
FIG. 7 shows another preferred embodiment of a chemical liquid container according to the present invention.
Figure 8:
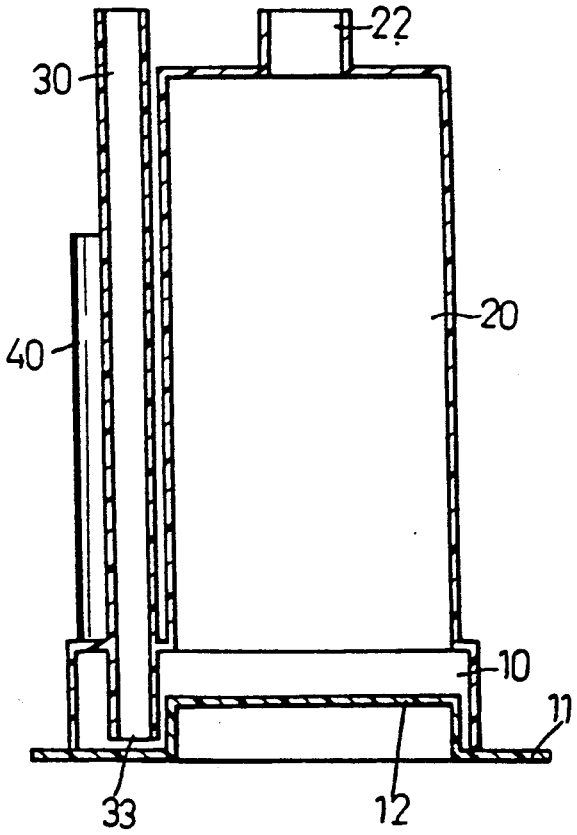
FIG. 8 shows still another preferred embodiment of chemical liquid container according to the present invention.

One end (511) of a siphon tube (50) is inserted through the cork (42) of the second auxiliary tube (40), and is disposed adjacent to the bottom of the lower portion (10) of the container (1). The other end (51) is connected to a pipe (52). The container of the present invention can be in any shape or form. FIGS. 7 and 8 show two differing forms of a container produced according to the present invention.

Figure 6:
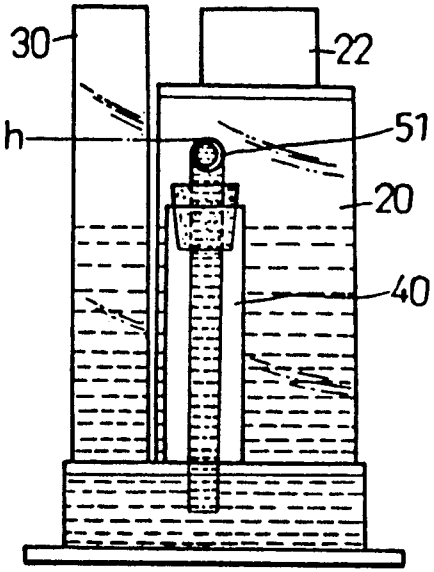
FIG. 6 shows a container of the present invention holding a larger volume of chemical liquid.

Referring to FIG. 6, when there is a large amount of solution available, the solution is poured into the upper portion (20) while the first tube (30) is opened, the second tube (40) and the free end of pipe (52) are closed. Under these conditions, the solution will rise to an "h" level in the siphon tube (51) while the upper portion (20) and the first tube (30) are filled only below the "h" level as shown in FIG. 6. Then the upper portion (20) and the first auxiliary tube are sealed. A siphon occurs when the clamped free end of the pipe 51 is released from clamping unless deliberately stopped, or until all drained, as in the conventional siphon, as shown in FIG. (2). A large siphon tube can also be installed in the upper portion of the container to cause this container to perform like conventional ones.

Figure 5:
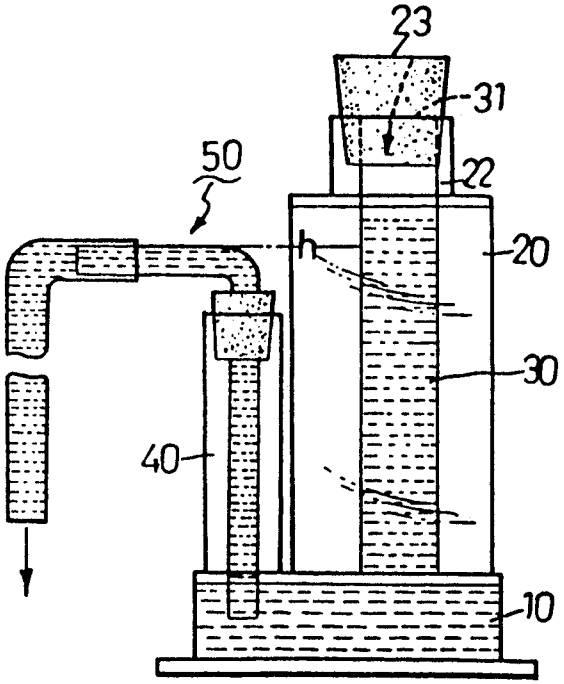
FIG. 5 shows a container of the present invention holding a limited amount of chemical liquid.

Referring to FIG. 5, when only a small amount of solution is available, the solution is filled into the first auxiliary tube (30) while the upper portion (20) and the second auxiliary tube (40), and the outer end of the siphon (51) are sealed. Under this condition, the solution will first of all fill the lower portion (10), the siphon tube (51) and later rises to a "h" level in the first auxiliary tube (30). The first tube is sealed so that a difference of pressure exists in the first tube and the siphon tube. A siphon occurs when the clamped pipe connected to the siphon tube is opened.

The container according to this invention can be constructed in any form, but must have the base portion with a smaller volume relative to the upper portion, the second auxiliary tube preferably has a larger diameter but lesser height than the first auxiliary tube, and one end of the siphon tube must be adjacent to the bottom of the lower portion of the container.

As shown in FIG. 7 the upper portion 20' is integrally formed with the lower portion 10' and the first and second auxiliary tubes extend upward from either side of the lower portion. As shown the volume of the lower portion 9 in the container in FIG. (10) is reduced by the construction of the base (11) which includes an inward recess (12). Such containers function the same as the above.

While the invention has been explained in connection with what is considered to be most practical and preferred embodiment, the invention is not limited to the disclosure only, but on the contrary, it is intended to cover various modifications and equivalent arrangements within the broadest interpretation of the present invention so as to emcompass all such modifications and equivalent arrangements.

I claim:

1. A dispensing means comprising:

a container having an upper portion and a lower portion, the lower portion including a bottom closed end defined by a base, an upper closed end and a chamber defined between said bottom closed end and said upper closed end;

the upper portion including a tubular member having a lower end connected to said upper closed end of said lower portion and in communication with said chamber, and an upper open end which is substantially located above said upper closed end of said lower portion, said upper open end of said tubular member having a means for sealing the same;

a first auxiliary tube extending upward from said upper closed end of said lower portion and having a predetermined height, said first auxiliary tube having an upper open end which has a means for detachably sealing the same and a lower open end connected to said upper closed end of said lower portion and in communication with said chamber;

a second auxiliary tube having a lesser height than said predetermined height of said first auxiliary tube, said second auxiliary tube having a lower end connected to said upper closed end of said lower portion and in communication with said chamber, and an upper open end which is substantially located above said upper closed end of said lower portion, said upper open end of said second tubular member having a means for detachably sealing the same; and a siphon tube having a first and a second open end, said first open end being inserted through said second auxiliary tube and disposed adjacent to the bottom of said chamber, said second open end extending outside of said second auxiliary tube, and extending downward to a position lower than said bottom closed end, said second open end of said siphon tube having a means for closing and opening the same.

2. A dispensing means as claimed in claim 1, wherein said tubular member has a volume greater than the volume of said chamber.

3. A dispensing means as claimed in claim 1, wherein said chamber has an inward recess in said bottom closed end of the same.

* * * * *